US005330175A

United States Patent [19]

Kim

[11] Patent Number: 5,330,175

[45] Date of Patent: Jul. 19, 1994

[54] BASKETBALL ASSEMBLY WITH ROTABLE AND LINEARLY DISPLACEABLE HOOP

[76] Inventor: Samuel Kim, 3820 Charlemagne Dr., Hoffman Estates, Ill. 60195

[21] Appl. No.: 914,763

[22] Filed: Jul. 15, 1992

[51] Int. Cl.[5] ..... A63B 63/08

[52] U.S. Cl. ..... 273/1.5 R; 273/402; 273/406

[58] Field of Search ..... 273/1.5 R, 1.5 A, 397, 273/402, 406; D21/201

[56] References Cited

U.S. PATENT DOCUMENTS

D. 315,938 4/1991 Doyle ..... D21/201
4,667,957 5/1987 Joseph ..... 273/397 X
4,805,917 2/1989 Cochran et al. ..... 273/397
5,035,423 7/1991 Arciniega ..... 273/1.5 A
5,074,552 12/1991 Gomez et al. ..... 273/1.5 A
5,171,009 12/1992 Filewich et al. ..... 273/1.5 A

*Primary Examiner*—Paul E. Shapiro
*Attorney, Agent, or Firm*—Laff, Whitesel, Conte & Saret

[57] ABSTRACT

An automated game assembly for use by at least one player, the assembly of the type having a basketball hoop mounted to a backboard, the basketball hoop and the backboard being mounted on a vertical support, the game assembly comprising means for rotating the basketball hoop and the backboard about a vertical axis, the vertical axis extending through the basketball hoop and offset horizontally from the backboard and the vertical support, and means for linearly displacing the basketball hoop and backboard away from and toward the player.

12 Claims, 5 Drawing Sheets

BASKETBALL ASSEMBLY WITH ROTABLE AND LINEARLY DISPLACEABLE HOOP

FIELD OF THE INVENTION

This invention relates to automated games. More particularly, this invention relates to an automated basketball assembly having a rotatable and linearly displaceable basketball hoop and backboard for playing a variety of basketball games.

BACKGROUND OF THE INVENTION

Professional and recreational basketball have been popular with both adults and children for years. Its popularity appears to have intensified recently due, in part, to extensive media coverage of college and professional basketball games and the emergence of various basketball superstars. Accordingly, there is an increasing demand for basketball paraphernalia and games, including basketball games that may be found in arcades, bars or basketball training facilities.

A variety of basketball games are known. Most of these games include stationary basketball hoops and backboards which are mounted within partially enclosed areas. Players are positioned at a set distance from and directly in front of the fixed hoops for shooting basketballs. The basketballs are returned to the players via an inclined surface beneath the basketball hoop. The basketballs usually remain, en masse, at the bottom of the inclined surface until shot at the basketball hoop by the player. Play continues until a timer-activated automatic mechanism intercepts the basketballs on an upper portion of the inclined surface and precludes them from returning to the player. A scoring device calculates the number of successfully shot basketballs and permits the player to compete with himself or herself or another.

Other known automated basketball games include basketball hoops and backboards which are rotatable or movable towards or away from players. These games were developed for presenting players with a variety of different angled shots and distances from the players to the basketball hoops and backboards. While the known movable basketball games present players with a variety of shots and are an improvement over the games having stationary hoops and backboards, they are generally less than satisfactory for numerous reasons, as described below.

First, the known movable basketball games require and occupy considerable space for their assembly and operation, which is particularly problematic when those games are intended for use in bars or other establishments of limited space. This large space requirement is due, in some instances, to the manner in which the basketball hoop is rotated or moved towards and away from players. Since most prior games are wider than the typical doorway of 36 inches, the games must be nearly completely disassembled to pass through the doorway.

Second, with the known movable basketball games, it is difficult to control the delivery and return of basketballs one at a time to players. Instead, basketballs are usually returned to players en masse so that there are always several basketballs accessible to the player at any given time. This permits the player to keep shooting balls even after the game has stopped and permits the improper removal of balls from the game.

Third, the mechanisms which move the known movable basketball hoops and backboards generally are unprotected from thrown basketballs and are therefore susceptible to damage. Moreover, these same exposed mechanisms often interfere with the delivery and return of basketballs which are deflected or blocked from the proper return path. When the games are income generating, as they often are, frequent breakdowns result in financial losses to the owner.

Fourth, variations in game play are limited with the known movable basketball games. Specifically, game play typically involves one or more players shooting basketballs at hoops against a timed deadline. This limits interest and discourages repeated use.

Thus, while the existing movable basketball games offer players the basic essentials—movable hoops and backboards and a plurality of basketballs—they are extremely limited in their structure and operation, as explained above.

Accordingly, an object of the present invention is to provide an automated basketball game having an improved rotatable and linearly displaceable basketball hoop and backboard.

Another object of the present invention is to provide an automated basketball game that presents to the players a hoop and backboard in a variety of different positions.

Another object of the present invention is to provide an automated basketball game that requires minimal space for assembly and operation and can easily pass through a typical doorway without extensive disassembly.

Another object of the present invention is to provide an automated basketball game that returns basketballs shot at the hoop and backboard and feeds them, one at a time, to the player(s).

Another object of the present invention is to provide an automated basketball game that permits the players to play a multiplicity of different games.

Yet another object of the present invention is to provide an automated basketball game that is adjustable in height for accommodating both adults and children and which also is compactible for shipping purposes.

A further object of the present invention is to provide an automated basketball game in which critical components are protected from impact and damage due to the basketballs, and in which these components move with the basketball hoop and backboard.

SUMMARY OF THE INVENTION

The present invention, in a preferred embodiment, accomplishes the foregoing objects by providing an automated game assembly for use by at least one player, having a target for a ball, a rotation unit for rotating the target about a vertical axis, and a linear displacing unit for linearly displacing the target away from and toward a player. The assembly further includes a means for dispensing or returning balls shot at the target and feeding them, one at a time, to the player. A partially netted frame confines and supports the other components. A control station is provided for automatically controlling the operation and selecting the various play modes of the game.

The automated game assembly may be adjusted by lowering the target to accommodate young children or less experienced players. Moreover, the entire assembly, including the frame, is compactible for shipping purposes and limited space restrictions. The assembly may be played by one or more players and may be programmed to offer a virtually endless number of games.

The above, as well as other objects and advantages of the invention, will become apparent from the following detailed description of the preferred embodiment, reference being made to the accompanying drawings.

DETAILED DESCRIPTION OF THE INVENTION

Figure 1:
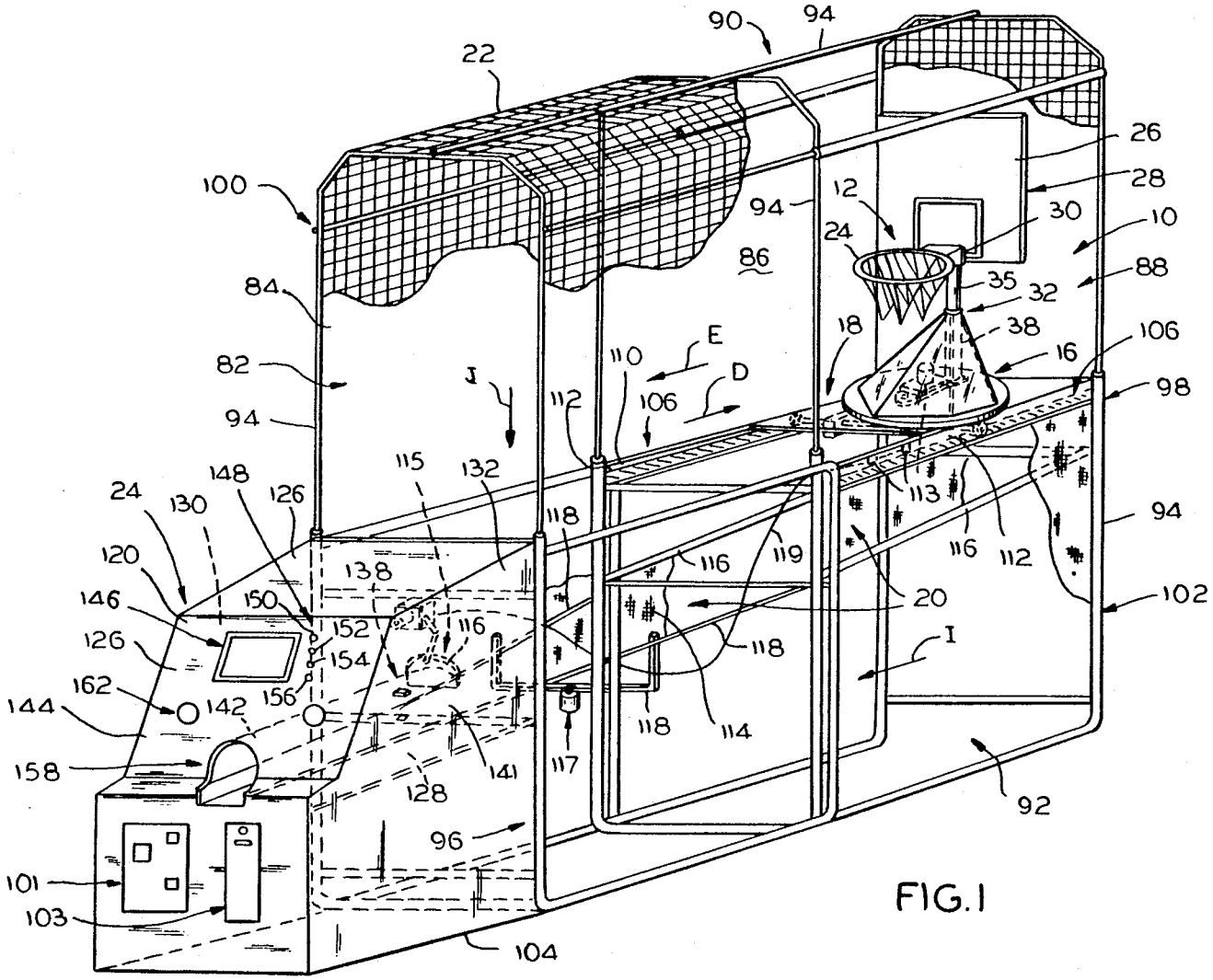
FIG. 1 is a perspective view of a preferred embodiment of the inventive automated game assembly.

Generally referring to FIG. 1, the invention provides an automated game assembly, generally denoted by the numeral 10, for use by at least one player and having a target 12 for a ball 14, a rotation unit 16 for rotating the target about a vertical axis 17, and a linear displacing unit 18 for linearly displacing the target away from and toward the player. Automated game assembly 10 further includes a means 20 for dispensing or returning balls shot at the target and feeding them, one at a time, to the player. A partially netted frame 22 confines and supports many of the components of the automated game assembly. A control station 24 is electronically connected to the target 12 and other components for controlling the operation and scoring of the game.

Figure 2:
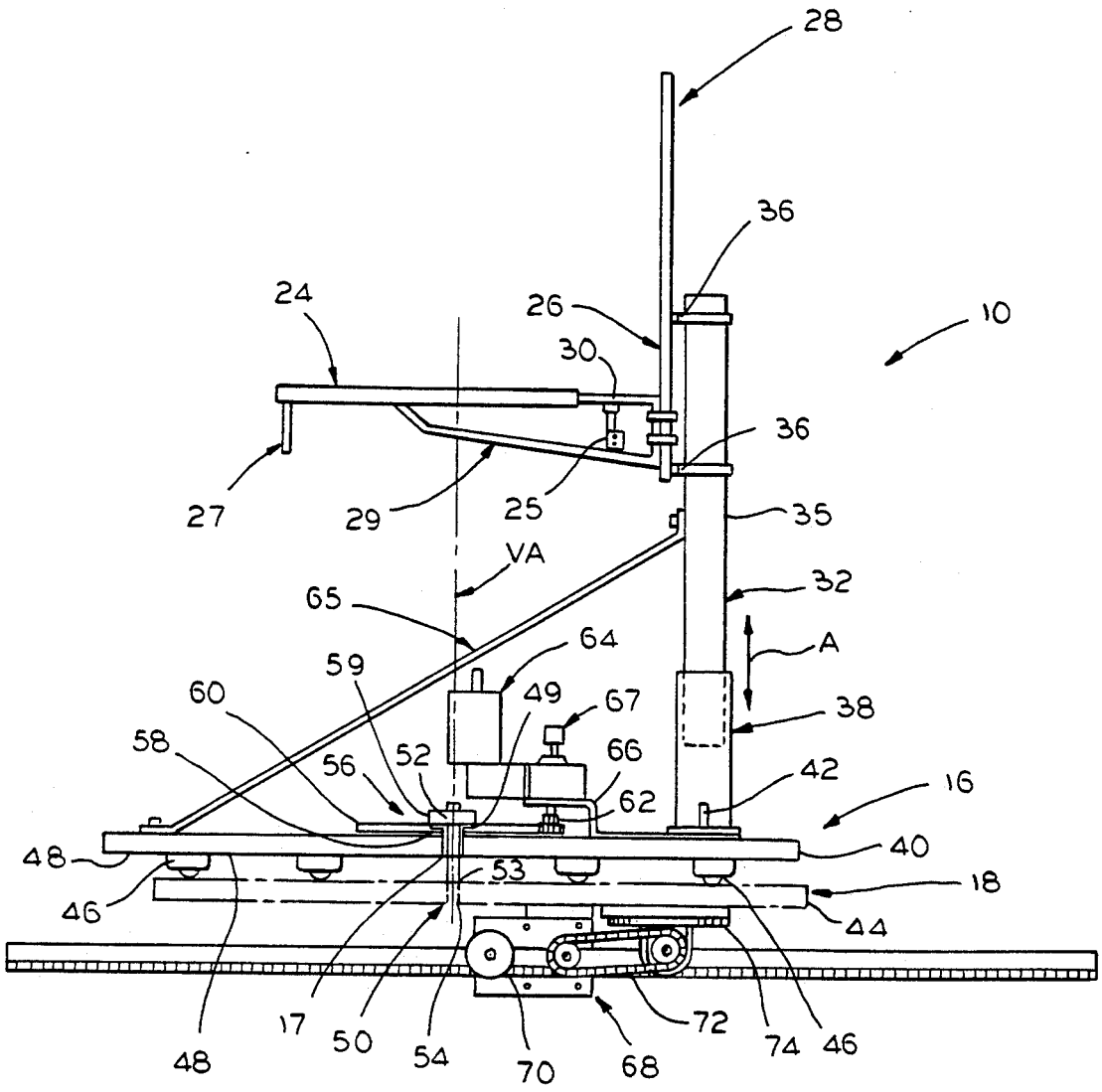
FIG. 2 is a side view of the rotatable and linearly displaceable target of the inventive automated game assembly of FIG. 1.

Referring first to FIGS. 1-2, in a preferred embodiment, target 12 of automated game assembly 10 includes a basketball hoop or goal 24 that is perpendicularly mounted on one side to the front portion 26 of planar backboard 28 by an L-shaped bracket 30. A proximity switch 25 may be located between basketball goal 24 and backboard 26 on L-shaped bracket 30 for sensing whether balls have entered goal 24 and should be scored. A bumper bracket 27 is located on the front side of basketball goal 25 closest to the player and diametrically opposite to proximity switch 25 for preventing false readings by the switch that may be caused by balls improperly entering goal 24 from beneath. Likewise, a side support 29 extends from L-shaped bracket 30 to the front of each side of goal 24 for preventing similar incorrect readings by the proximity switch when target 12 is rotated to expose the sides of the target to thrown balls. Side support 29 further provides additional support to basketball goal 24. Alternatively, proximity switch 25 may be mounted on a rigid collar 27 located in the bottom of goal 24. In this embodiment, the rigidity of collar 27 eliminates the need for bumper bracket 27 or overextended side supports 29.

Basketball goal 24 and backboard 26 are mounted on a telescoping, vertical support 32 which includes an upper goal post 35 and a lower base post 38. Upper goal post 35 of vertical support 32 is coaxial with and has a smaller diameter than lower base post 38 to allow for telescoping movement between the two sections, as indicated by the arrow A in FIG. 2. This telescoping arrangement between the two sections enables vertical support 32 to be positioned at different heights both to accommodate younger or less experienced players and for shipping purposes.

Backboard 26 is affixed at its rear to upper goal post 34 of vertical support 32 by L-shaped brackets 36. Lower base post 38 of vertical support 32 is securely affixed and perpendicularly mounted by L-shaped brackets 42 to circular plate 40, which, as part of the rotation unit, rotatably moves basketball goal 24 and backboard 26.

Rotating plate 40 is located above and attached to a linearly moving plate 44 (discussed below). Rotating plate 40 is rotated by a first gear assembly 56 and is spaced from linearly moving plate 44 by a plurality of metal bearings 46 that are affixed adjacent the periphery and to the underside of plate 40 by attachment means 48 (see FIGS. 3-4). Bearings 46 provide rotatable support to rotatable plate 40 and operate in conjunction with a hollow pivot post 50 to enable rotatable plate 40 to pivotally rotate through a preselected angle Z from point DD (0°) on linearly moving plate 44, in either a clockwise or counterclockwise direction, as indicated by arrows B and C in FIG. 3. When rotatable plate 40 is aligned with point DD, the goal 24 and backboard 26 are aligned perpendicularly to the player's line of sight. As the goal 24 and backboard 26 move through angle Z to a preselected position, the backboard is angled relative to the player's line of sight LS, thereby providing an angle shot. It is preferred that angle Z be not greater than ±90° from point DD. A plurality of guide members 51 which are attached to linearly moving plate 44 engage the periphery of and provide rotatable plate 40 with stability during its rotational movement.

Hollow pivot post 50 extends through centrally located openings 49, 53, in rotatable plate 40 and linearly moving plate 44, and surrounds a vertical axis A about which rotatable plate 40 rotates or pivots. Vertical axis A extends through basketball goal 24 and is offset horizontally from backboard 26. This arrangement permits 180° of rotation of the backboard and goal, while minimizing the radius required for the backboard and goal to swing through angle Z. Pivot post 50 includes an upper portion 52 which projects beyond the upper surface of rotatable plate 40 to accommodate part of first gear assembly 56, and a lower portion 54 which extends through linear moving plate 44. A self-aligning flange bearing 58 (FIG. 2) is disposed in opening 51 of rotatable plate 40 which enables pivot post 50 to freely rotate within the opening. A non-threaded member 59 is attached to upper portion 52 of pivot post 50 for securing pivot post 50 to the plates.

Rotatable plate 40, basketball goal 24 and backboard 26 are rotationally moved by first gear assembly 56, which consists of a large driven gear 60 and a smaller drive-gear 62. Large driven gear 60 is located between member 59 and rotatable plate 40 and includes a central opening (not shown) for accommodating upper portion 52 of pivot post 50. The bottom surface of driven gear 60 rests on self-aligning flange bearing 58 and does not contact rotatable plate 40, thereby eliminating frictional interference between them. Engaging driven gear 60 is smaller drive-gear 62. A gear motor 64 is mounted above and connected to drive-gear 62 by a pair of motor mounting brackets 66. The wire connections (not shown) from gear motor 64 pass through pivot post 50 to the underside of linearly moving plate 44, where they are ultimately connected to a power source.

A first potentiometer 67 is attached to first gear motor 64 to inform the microcomputer unit ("MCU"), described subsequently herein, of the rotational position or location of the goal 24. A skirt member 65 is attached to and extends from upper goal post 34 to rotatable plate 40. Skirt member 65 protects first-gear assembly 56 and rotational gear motor 64 from ball impact and damage and additionally functions to dampen and thereby reduce the bounce of thrown basketballs.

Figure 4:
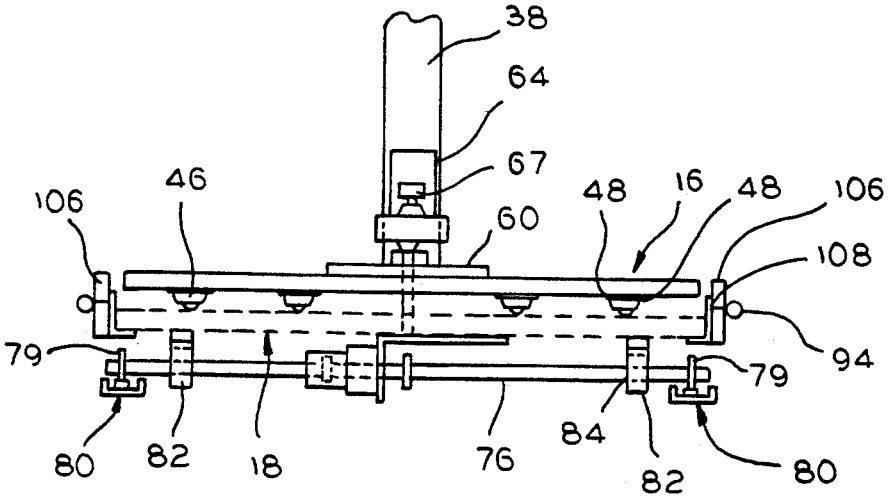
FIG. 4 is a cross-sectional view of the lower base support and movable plates of FIG. 3.

In addition to linearly moving plate 44, the linear displacing unit includes a second gear assembly 68 affixed to linearly moving plate 44, which operates linearly moving plate 44 so as to linearly displace target 12 away from and toward players in the directions indicated by arrows D and E in FIG. 1. Second gear assembly 68 is attached to linearly moving plate 44 by a plurality of L-shaped brackets 74, and it includes a second gear motor 70 with an attached chain drive 72 (FIG. 2). A second potentiometer 75 informs the MCU of the linear position of goal 24. Chain drive 72 engages sprocket 78 mounted centrally on elongated rod 76 which extends across the entire width of linearly moving plate 44. A pair of sprockets 79 are located at each end of elongated rod 76 (FIG. 4). Adjacent each end sprocket 79 is a pillow block 82 which is located beneath and is attached to linearly moving plate 44 by any suitable attachment means. Each pillow block 82 includes an opening 84 for receiving and supporting elongated rod 76. Pillow block 82 allows elongated rod 76 to rotate freely within openings 84.

Figure 3:
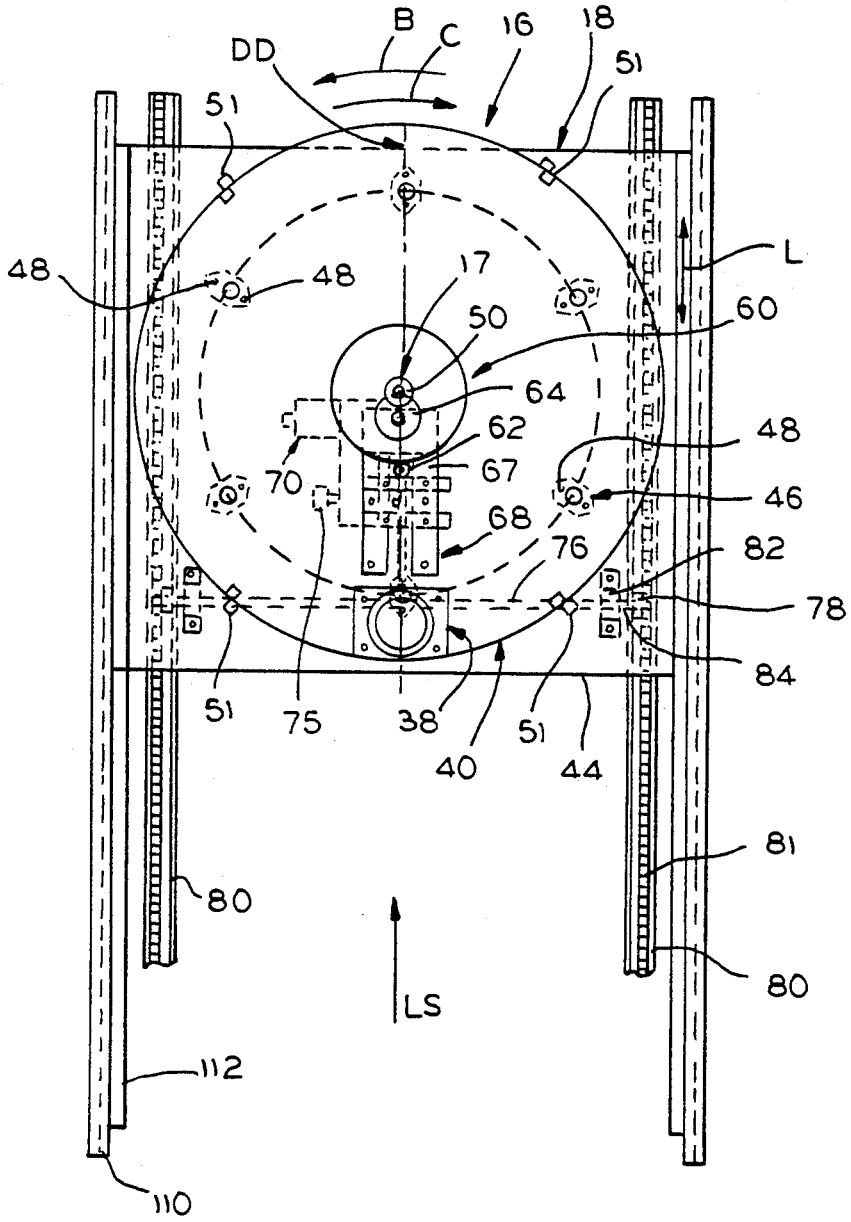
FIG. 3 is a plan view of the rotatable and linearly movable plates that support the target of FIG. 2.

At both ends of and perpendicular to elongated rod 76 are a spaced pair of U-shaped, chain support tracks 80 that each include a linear chain 81 which is adapted to receive teeth or other projections of end sprockets 79. Tracks 80 extend the length L for which the linearly plate moving 44, and hence the goal 24, is desired to travel, as shown in FIG. 3. Tracks 80 are parallel to one another and to the sides of netted frame 22.

Linearly moving plate 44 is affixed by attachment brackets 108 to a spaced pair of slide assemblies 106 located above chain support tracks 80 (FIG. 1). Slide assemblies 106 include an outer, slide holder 110 affixed to frame assembly 22, and an inner slide 112 that movably extends horizontally within slide holder 110.

Movable slide 112 includes a plurality of clips 113 which secure a cable 119 that supplies electrical power to rotation unit 16 and linear displacing unit 18. Cable 119 extends from rotation unit 16 and linear displacing unit 18, along the inside surface of movable slide 112, to a control station 104 located in front or to the player's side 82 of frame 22. Cable 119 includes sufficient slack so that as rotation unit 16 and linear displacing unit 18 move and as slide 112 is extended within slide holder 110, cable 119 does not disengage from its various connections.

Figure 5:
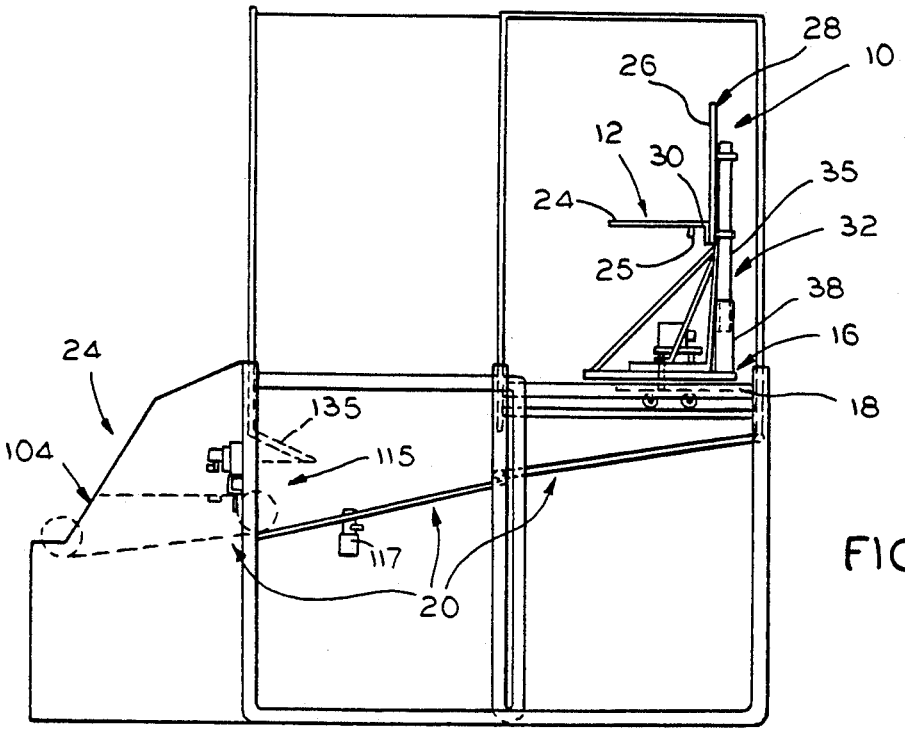
FIG. 5 is a side view of the inventive automated game assembly of FIG. 1.

Referring to FIGS. 1 and 5, a ball return unit 20 is located below plates 40, 44. The ball return unit includes a ball chute 114 that is downwardly inclined towards the front 82 of frame 22, and a ball dispensing assembly 115. Ball chute 114 is formed by a plurality of material-covered struts 116, 118 that are attached to frame 22. Struts 116 are located below slide assemblies 106 and form the rearmost portion of the chute, and struts 118 extend forward from and below struts 116 and converge at the front of frame 22 adjacent to ball dispensing assembly 115. Ball chute 114 is preferably made of a vinyl or other flexible material which dampens the bounce of the ball.

A vibrator motor 117 is desirably located beneath and is attached to stuts 118 of ball chute 114. Vibrator motor 117, when activated, transmits vibration through struts 118 to ball chute 114 to dislodge any balls which have failed to roll down the chute to ball dispensing assembly 115. As an alternative to the vibrator motor, any other vibrating or otherwise movable mechanism may be located on, beneath, or in close proximity to the ball chute.

Figure 6:
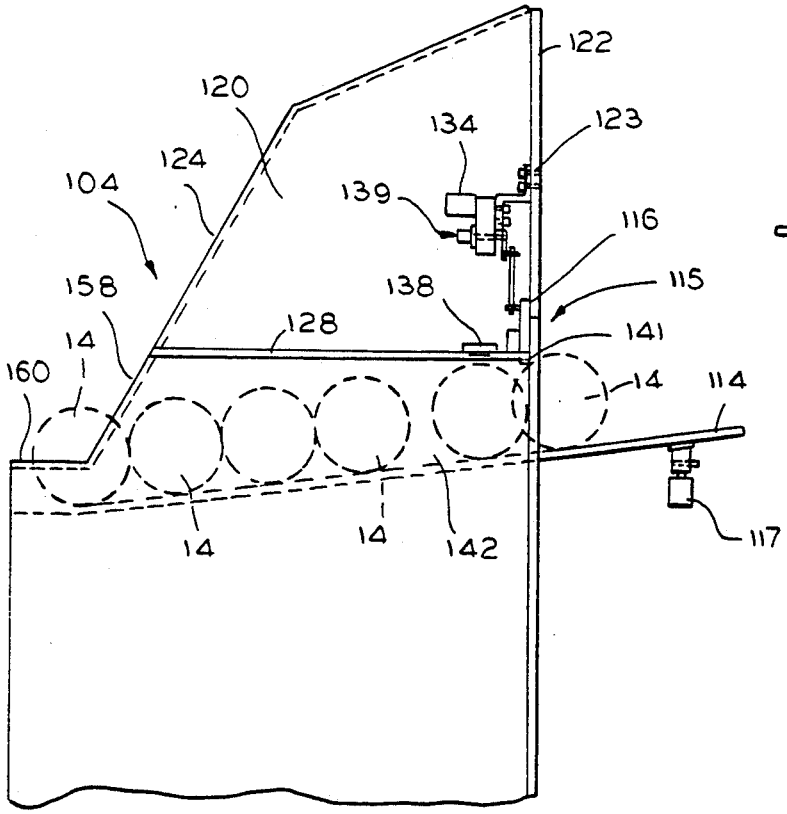
FIG. 6 is a partial side view of the ball return assembly shown in FIG. 1.
Figure 7:
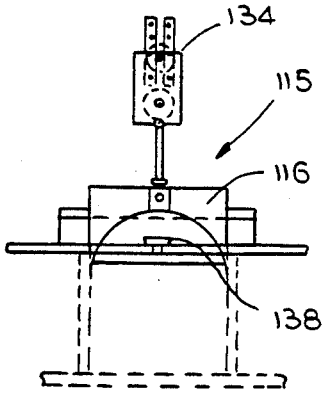
FIG. 7 is a cross-sectional view of the ball dispensing gate shown in FIG. 6.

Ball dispensing assembly 115 is located at the front of frame 22 in a separate compartment 120 of adjoining control station 104. The housing 124 of control station 120 includes a rear wall 122 and a bottom 128 (see FIGS. 6 and 7). Dispensing assembly 115 includes a ball dispensing gate 116 that preferably moves vertically, but may move pivotally, by a gear motor 134 that is attached to rear wall 122 of compartment 120 by mounting bracket 123. Gear motor 134 is actuated to open or close gate 116 by a ball sensor 138, such as a photocell, located on bottom wall 128 of compartment 120 adjacent to gate 116. A third potentiometer 139 attached to gear motor 134 informs the MCU whether the gate is closed or open. A protective ball shield 135 extends downwardly from rear wall 122 towards ball chute 114 for protecting ball dispensing assembly 115 from basketballs which have been shot.

Ball sensor 138 operates by detecting an individual ball 14 as it passes from ball chute 114, through channel opening 141 in rear wall 128, and into a channel 142 beneath compartment 120 in housing 124. As soon as a ball passes beneath ball sensor 138, gate 116 is closed. Thus, gate 116 allows only a single ball to enter channel 142. If a ball is not detected in channel 142 by ball sensor 138, the vibrator 117 is actuated for clearing balls that sometimes become obstructed on ball chute 114. The dispensing gate 116 remains in an open position and the vibrator continues to vibrate ball chute 114 until a ball passes through gate 116 and beneath ball sensor 138.

Referring to FIGS. 1 and 5, the target 12, rotation unit 16, and linear displacing unit 18 are housed within and supported by a partially netted frame 22, which is generally box-shaped in configuration and includes an open front 82, a first side 84, a second side 86, a rear 88, a top 90 and a bottom 92. Frame 22 is preferably less than 36 inches in width so that it will fit through a typical door frame. The frame is desirably formed by a plurality of rigid metal or plastic interconnected pipes 94 that are fastened together by any suitable fastening means to form the skeleton of the assembly. Pipes 94 of frame 22 are arranged to form a front section 96 and a rear section 98, each of which include an upper portion 100 and a lower portion 102. Front section 96 telescopes horizontally into rear section 98, in the direction indicated by arrow I, and upper portion 100 telescopes into lower portion 102 in the direction indicated by arrow J. This telescopic feature of frame 22 facilitates transportation and shipping purposes, and it also allows the user to adjust the volume of space occupied by the assembly during use.

Control station unit 104 extends forwardly from the front 82 of frame 22 and controls the operation of the basketball games. A control panel 144 is located on front wall 126 of housing 124 and includes, in part, a ball opening 158 which allows for balls to pass from channel 142 to a ball nest 160 for access to players. Control panel 144 further includes a video monitor 146 and a plurality of control actuators 148 (such as push buttons) which allow the player to select a scoring method or set of game rules or to commence play. The control actuators 148 are electronically connected to the MCU 150 located within housing 124. The MCU reads the signal sent as a result of the player pushing an actuator 148 and controls the movement of the target 12 and releases balls to the players accordingly. Suitable legend or instructional material may be displayed on monitor 146 to indicate the functions of actuators 148. An audible indicator 162, such as a speaker, is also present on front wall 124 of unit 104 for providing appropriate sounds to accompany scoring events or to attract passers-by when activated by MCU 150. Control unit 104 is connected to an outside power source, such as an AC receptacle (not shown).

If the automated game assembly 10 is used in a public place, such as an arcade or bar, it may be desirable to collect payment from the players. Accordingly, a payment receiving unit 101 and ticket dispenser 103 are provided as part of control station unit 104. The payment receiving unit 101 is electronically connected to the MCU 150 as described hereafter so that play is initiated and balls dispensed, or other appropriate action may be taken to prevent play by users who have not paid the requisite fee.

Figure 8:
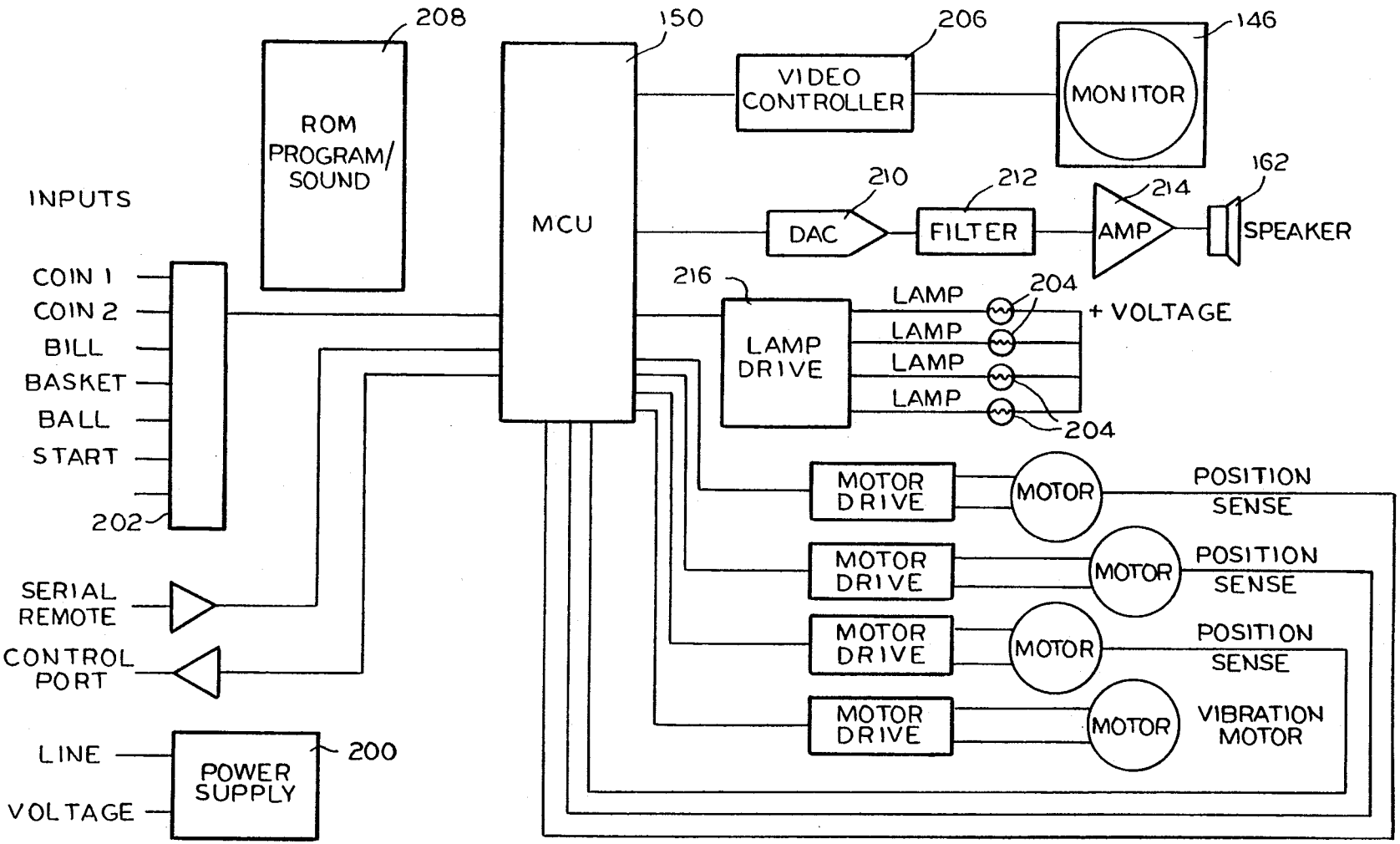
FIG. 8 is a block diagram of the control system for the inventive automated game assembly.

FIG. 8 demonstrates generally the electronic structure of the invention. The MCU is programmed to direct the various desired game functions. After connection to power supply 200, the MCU 150 reads the inputs 202, including whether the proper sum of money has been paid, which game has been selected, and the number of players. The MCU activates the lamp drive 216 and appropriate lamps 204, thereby confirming to the player the choices made. The MCU also activates the video controller 206 and monitor 146, providing visual information to the player. Audio information and sound effects stored in a ROM program 208 are initiated by the MCU and provided through a digital to audio converter 210, filter 212, amplifier 214 and speaker 162. Depending on the particular game selected and number of players involved (e.g. PIG, HORSE, number of successful shots within a predetermined time period, etc), the MCU will activate the appropriate motor drives 218, 220, or 222 and corresponding motors 64, 70, or 134 to position the target 12 and allocate the proper number of balls through the ball dispensing assembly 115. In other words, the position of the hoop relative to the player may change following a predetermined time period, following a round of shots from each player, or following a successful shot, depending on the programming of the MCU.

To play a game, a player activates the invention (such as by paying the appropriate fee into the payment receiving unit 101), selects a game, and indicates the number of players. A basketball is then automatically released from ball chute 114 into ball nest 160, whereupon the first player shoots it toward target 12 through the open front 82 of frame 22. If the basketball enters target 12, goal sensor switch 25 transmits a signal to control station unit 104 indicating a score. Regardless of whether the player scores, the shot basketball drops onto ball chute 114 and gravitationally rolls towards ball dispensing gate 116 of ball dispensing assembly 115, where it remains, inaccessible to the players, with other basketballs until gate 115 opens. At predetermined times, gate 115 opens and allows an individual ball to pass through channel 142 to ball nest 160 of control station unit 104. Gate 115 then immediately closes after it receives the signal from ball sensor 138 which indicates that a ball has entered channel 142 and is accessible to the players. Periodically, target 12 rotates clockwise and counterclockwise to clear up any ball obstructions.

After each shot, or after all players have taken a shot, or after a predetermined time period (depending on the game selected), the MCU transmits a signal to the gear motor 64 of first gear assembly 56 causing gears 60, 62 to rotate rotating moving plate 40. Likewise, a signal may be simultaneously transmitted to gear motor 70 of second gear assembly 68 which causes chain drive 72 to rotate sprocket 78 and elongated rod 76. The rotational movement of sprockets 79 in chain support tracks 80 causes linearly moving plate 44, rotating plate 40, and target 12 to move away from or towards the players. Game play continues until a timed deadline expires, or until an allowed number of shots are taken and/or missed, or until a certain score is reached.

Regardless of the game chosen, each game provides a variety of different shots for the player(s) because of the game's ability to automatically move the target rotationally and linearly. Scoring is determined by whether a ball enters the target at appropriate times. Sometimes the score is displayed on the monitor 146 as a numerical figure, and other times the score is displayed as a series of letters as, for example, in the game of PIG or HORSE. For the usual game, the player with the highest numerical score or least amount of letters wins the game.

The automated game assembly 10 has been described and shown in the Figures as a basketball game for purposes of illustration only. Thus, it should be understood that the automated game assembly is not limited to basketball but may be directed to any other sport or game that includes a target and at least one ball.

Therefore, it should be recognized that, while the invention has been described in relation to a preferred embodiment, those skilled in the art may develop a wide variation of structural details without departing from the principles of the invention. Accordingly, the appended claims are to be construed to cover all equivalents falling within the true scope and spirit of the invention.

The invention claimed is:

1. An automated game assembly for use by at least one player, said assembly of the type having a basketball hoop mounted to a backboard remotely located from said player, the basketball hoop and the backboard being mounted on a vertical support, said game assembly further comprising:

means including a rotating plate for rotating the basketball hoop and backboard about a vertical axis, said vertical axis extending through said basketball hoop and offset horizontally from said vertical support, said vertical support mounted on said rotating plate;

means including a linear displacing plate for linearly displacing the basketball hoop and backboard away from and toward the player, said rotating plate rotatably mounted to said linear displacing plate; and a ball return chute located beneath said rotating plate and said linear displacing plate; and a pivot post surrounding said vertical axis and extending through said rotating plate and into said linear displacing plate.

2. The automated game assembly of claim 1 wherein said rotating means further comprises a rotation gear assembly and motor for rotating said rotating plate about said pivot post.

3. The automated game assembly of claim 2 wherein said rotation gear assembly and motor moves with said rotating plate.

4. The automated game assembly of claim 1 including a frame at least partially surrounding said rotating and linear displacing means, and wherein said linear displacing plate is slidably mounted within said frame.

5. The automated game assembly of claim 4 wherein said linear displacing means further comprises a linear gear assembly and motor for moving said linear displacing plate.

6. The automated game assembly of claim 5 wherein said linear gear assembly and motor moves with said linear displacing plate.

7. An automated game assembly for use by at least one player, said assembly of the type having a basketball hoop mounted to a backboard remotely located from said player, the basketball hoop and the backboard being mounted on a vertical support, said game assembly further comprising:

means for rotating the basketball hoop and the backboard about a vertical axis, said vertical axis extending through said basketball hoop and offset horizontally from said vertical support;

means for linearly displacing the basketball hoop and backboard away from and toward the player; and means for returning balls shot at the basketball hoop and feeding them, one at a time, to the player.

8. An automated game assembly for use by at least one player, said assembly of the type having a basketball hoop mounted to a backboard remotely located from said player, the basketball hoop and the backboard being mounted on a vertical support, said game assembly further comprising:

means for rotating the basketball hoop and the backboard about a vertical axis, said vertical axis extending through said basketball hoop and offset horizontally from said vertical support;

means for linearly displacing the basketball hoop and backboard away from and toward the player;

a frame at least partially surrounding said rotating and linear displacing means, and wherein said linear displacing means includes a glide member that is slidably mounted within said frame;

said rotating means further comprising a rotatable member that supports said vertical support and is mounted on said glide member; and a pivot post surrounding said vertical axis and extending through said rotatable member and said glide member.

9. The automated game assembly of claim 8 and a ball chute affixed to said frame and located beneath said rotatable member and said glide member, said ball chute being downwardly inclined away from said basketball hoop and backboard for directing balls to the player.

10. An automated game assembly for use by at least one player, said assembly of the type having a basketball hoop mounted to a backboard remotely located from said player, the basketball hoop and the backboard being mounted on a vertical support, said game assembly further comprising:

means for rotating the basketball hoop and the backboard about a vertical axis, said vertical axis extending through said basketball hoop and offset horizontally from said vertical support;

means for linearly displacing the basketball hoop and backboard away from and toward the player;

a frame at least partially surrounding said rotating and linear displacing means, and wherein said linear displacing means includes a glide member that is slidably mounted within said frame;

said rotating means further comprising a rotatable member that supports said vertical support and is mounted on said glide member;

a ball chute affixed to said frame and located beneath said rotatable member and said glide member, said ball chute downwardly inclined from said basketball hoop and backboard for directing balls to the player; and means for vibrating said chute.

11. An automated game assembly for use by at least one player shooting a ball, comprising:

a ball target remotely located from said player;

an enclosure at least partially surrounding said target, said enclosure having a ceiling, a rear wall, a front opening, a bottom, and two spaced side walls;

means for linearly displacing said target away from and towards said player, said linear displacing means including a pair of slides and a plate mounted thereto, said plate extending across substantially the entire distance between said side walls, said slides mounted to the side walls and spaced above said bottom of said enclosure for permitting sliding movement of said plate within said enclosure, and said target supported by said plate; and means for returning balls shot at said target to said player, said ball return means located within said enclosure, said ball return means extending from below said plate and said target toward said front opening.

12. An automated game assembly for use by at least one player shooting a ball, comprising:

a ball target remotely located from said player;

a rotatable place for supporting said ball target;

means for rotating said rotatable plate about a vertical axis;

a gliding plate parallel and connected to said rotatable plate;

bearing means affixed between said rotatable plate and said guiding plate permitting rotatable movement of said rotatable plate relative to said gliding plate and supporting said rotatable plate on said gliding plate;

means for linearly displacing said gliding plate, rotatable place and ball target away from and toward said player;

a frame at least partially surrounding said target, rotatable plate and sliding plate, said frame having a ceiling, a rear wall, a front opening, a bottom, and two side walls; and a pair of slides mounted to said frame above its bottom, said slides supporting said gliding plate; and a pivot post surrounding said vertical axis and extending through said rotatable plate and into said sliding plate.

* * * * *